US010830236B2

(12) United States Patent
Ignatiev et al.

(10) Patent No.: US 10,830,236 B2
(45) Date of Patent: Nov. 10, 2020

(54) COMPRESSOR INCLUDING BEARING AND UNLOADER ASSEMBLY

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 567 days.

(21) Appl. No.: 14/832,371

(22) Filed: Aug. 21, 2015

(65) Prior Publication Data

US 2015/0361983 A1 Dec. 17, 2015

Related U.S. Application Data

(63) Continuation of application No. 14/159,526, filed on Jan. 21, 2014, now Pat. No. 9,115,718.
(Continued)

(51) Int. Cl.
*F04C 29/00* (2006.01)
*F04C 18/02* (2006.01)
(Continued)

(52) U.S. Cl.
CPC ..... *F04C 29/0071* (2013.01); *F04C 18/0215* (2013.01); *F04C 23/008* (2013.01);
(Continued)

(58) Field of Classification Search
CPC ..... F04C 18/0215; F04C 2240/56; F04C 2240/605; F04C 23/008; F04C 27/001;
(Continued)

(56) References Cited

U.S. PATENT DOCUMENTS 4,300,875 A 11/1981 Fischer et al.
4,325,683 A 4/1982 Miyazawa
(Continued)

FOREIGN PATENT DOCUMENTS

CN 1186174 A 7/1998
CN 1249401 A 4/2000
(Continued)

OTHER PUBLICATIONS

International Search Report regarding U.S. Patent Application No. PCT/US2014/012319, dated Apr. 28, 2014.
(Continued)

*Primary Examiner* — Patrick Hamo
*Assistant Examiner* — Paul W Thiede
(74) *Attorney, Agent, or Firm* — Harness, Dickey & Pierce, P.L.C.

(57) ABSTRACT

A compressor is provided that may include a drive shaft, a compression mechanism, a bearing and an unloader. The drive shaft may include a main body and a crank pin extending from the main body. The compression mechanism may include first and second members. The crank pin may drivingly engage the second member and cause motion of the second member relative to the first member. The bearing may rotatably supporting the main body of the drive shaft. The unloader may rotatably engage the bearing and slidably engage the main body.

29 Claims, 2 Drawing Sheets

Related U.S. Application Data

(60) Provisional application No. 61/755,222, filed on Jan. 22, 2013.

(51) Int. Cl.
*F04C 23/00* (2006.01)
*F04C 27/00* (2006.01)

(52) U.S. Cl.
CPC ..... *F04C 27/005* (2013.01); *F04C 27/001* (2013.01); *F04C 2240/56* (2013.01); *F04C 2240/605* (2013.01)

(58) Field of Classification Search
CPC F04C 27/005; F04C 29/0071; F04C 15/0061; F04C 17/06; F16C 19/44; F04B 35/04
USPC ..... 418/182, 55.1–55.3, 55.5–55.6, 15; 384/29, 95, 129, 255, 276, 290, 296, 447; 417/410.1
See application file for complete search history.

(56) References Cited

U.S. PATENT DOCUMENTS

| | | | | |
|---|---|---|---|---|
| 4,435,137 | A | 3/1984 | Terauchi | |
| 4,877,382 | A | 10/1989 | Caillat et al. | |
| 4,993,928 | A | 2/1991 | Fraser, Jr. | |
| 5,186,546 | A | 2/1993 | Abe | |
| 5,295,813 | A | 3/1994 | Caillat et al. | |
| 5,370,513 | A | 12/1994 | Fain | |
| 5,378,129 | A | 1/1995 | Dunaevsky et al. | |
| 5,520,524 | A | 5/1996 | Takemoto et al. | |
| 5,520,527 | A | 5/1996 | Kim | |
| 5,545,019 | A | 8/1996 | Beck et al. | |
| 5,562,435 | A | 10/1996 | Cho et al. | |
| RE36,604 | E | 3/2000 | Sano et al. | |
| 6,056,523 | A * | 5/2000 | Won | F04C 23/008 418/15 |
| 6,079,962 | A | 6/2000 | Seibel et al. | |
| 6,089,840 | A | 7/2000 | Iizuka et al. | |
| 6,106,251 | A | 8/2000 | Monnier et al. | |
| 6,139,294 | A | 10/2000 | Haller | |
| 6,139,295 | A | 10/2000 | Utter et al. | |
| 6,146,119 | A | 11/2000 | Bush et al. | |
| 6,179,591 | B1 | 1/2001 | Clendenin et al. | |
| 6,189,248 | B1 | 2/2001 | Nagel et al. | |
| 6,193,489 | B1 | 2/2001 | Tarng et al. | |
| 6,273,616 | B1 * | 8/2001 | Pflug | F16C 19/44 384/447 |
| 6,398,530 | B1 | 6/2002 | Hasemann | |
| 6,428,294 | B1 | 8/2002 | Fenocchi | |
| 6,454,551 | B2 | 9/2002 | Kuroki et al. | |
| 6,695,600 | B2 | 2/2004 | Koo et al. | |
| 6,709,247 | B1 | 3/2004 | Clendenin et al. | |
| 6,821,092 | B1 | 11/2004 | Gehret et al. | |
| 7,273,363 | B1 | 9/2007 | Sun et al. | |
| 7,338,263 | B2 | 3/2008 | Young | |
| 7,661,939 | B2 | 2/2010 | Su et al. | |
| 8,186,981 | B2 | 5/2012 | Sugimoto et al. | |
| 9,115,718 | B2 | 8/2015 | Ignatiev et al. | |
| 9,188,124 | B2 | 11/2015 | Utpat et al. | |
| 10,156,236 | B2 | 12/2018 | Utpat et al. | |
| 10,215,175 | B2 | 2/2019 | Ignatiev et al. | |
| 2002/0057975 | A1 | 5/2002 | Nakajima et al. | |
| 2002/0098102 | A1 | 7/2002 | Gennami et al. | |
| 2003/0077193 | A1 | 4/2003 | Skinner | |
| 2004/0184931 | A1 | 9/2004 | Millet et al. | |
| 2005/0226755 | A1 * | 10/2005 | Tsuchiya | F04C 27/005 418/55.3 |
| 2007/0092390 | A1 | 4/2007 | Ignatiev et al. | |
| 2009/0246057 | A1 | 10/2009 | Sugimoto et al. | |
| 2009/0246059 | A1 | 10/2009 | Nakamura et al. | |
| 2010/0111709 | A1 | 5/2010 | Jayanth | |
| 2010/0166589 | A1 | 7/2010 | Iwano et al. | |
| 2011/0194966 | A1 | 8/2011 | Takeuchi et al. | |
| 2012/0257996 | A1 * | 10/2012 | Smith | F04B 35/04 417/410.1 |
| 2012/0258003 | A1 | 10/2012 | Hahn | |
| 2014/0219850 | A1 * | 8/2014 | Ignatiev | F04C 29/0071 418/55.5 |
| 2016/0069348 | A1 | 3/2016 | Utpat et al. | |
| 2017/0037850 | A1 | 2/2017 | Ignatiev et al. | |
| 2017/0067508 | A1 | 3/2017 | Sawamoto et al. | |
| 2018/0023570 | A1 | 1/2018 | Huang et al. | |
| 2019/0316584 | A1 | 10/2019 | Antimonov et al. | |
| 2019/0345939 | A1 | 11/2019 | Antimonov et al. | |

FOREIGN PATENT DOCUMENTS

| | | | |
|---|---|---|---|
| CN | 1126871 | C | 11/2003 |
| CN | 1632317 | A | 6/2005 |
| CN | 101255864 | A | 9/2008 |
| CN | 101545483 | A | 9/2009 |
| CN | 101576072 | A | 11/2009 |
| CN | 101684811 | A | 3/2010 |
| CN | 102705235 | A | 10/2012 |
| CN | 203453056 | U | 2/2014 |
| CN | 203822627 | U | 9/2014 |
| CN | 107575380 | A | 1/2018 |
| CN | 210087600 | U | 2/2020 |
| EP | 1253323 | B1 | 3/2005 |
| JP | 2000161256 | A | 6/2000 |
| JP | 2009114943 | A | 5/2009 |
| JP | 2012132409 | A | 7/2012 |
| KR | 20000006361 | A | 1/2000 |
| KR | 20090077294 | A | 7/2009 |
| KR | 100996628 | B1 | 11/2010 |
| KR | 100996628 | B1 | 11/2010 |
| WO | WO-9410425 | A1 | 5/1994 |
| WO | WO-2010113794 | A1 | 10/2010 |
| WO | WO-2014155546 | A1 | 10/2014 |
| WO | WO-2017057159 | A1 | 4/2017 |

OTHER PUBLICATIONS

Written Opinion of the International Searching Authority regarding Application No. PCT/US2014/01239, dated Apr. 28, 2014.
Final Office Action regarding U.S. Appl. No. 14/159,526, dated Feb. 3, 2015.
Office Action regarding Chinese Patent Application No. 201480005721.X, dated Jul. 15, 2016. Translation provided by Unitalen Attorneys at Law.
Office Action regarding U.S. Appl. No. 14/159,526, dated Oct. 1, 2014.
Written Opinion of the International Searching Authority regarding Application No. PCT/U52014/012319, dated Apr. 28, 2014.
U.S. Appl. No. 14/941,827, filed Nov. 16, 2015, Ajay Utpat et al.
U.S. Appl. No. 15/222,361, filed Jul. 28, 2016, Kirill M. Ignatiev et al.
First Notification of Making Rectification issued by The State Intellectual Property Office of the People's Republic of China on Aug. 9, 2013, regarding Application No. 201320233026.1. Translation provided by Unitalen Attorneys at Law.
Office Action regarding U.S. Appl. No. 13/869,567, dated Mar. 25, 2015.
Office Action regarding Chinese Patent Application No. 201310158952.1, dated May 5, 2015. Translation provided by Unitalen Attorneys at Law.
International Search Report regarding International Application No. PCT/US2016/045180, dated Oct. 12, 2016.
Written Opinion of the International Searching Authority regarding International Application No. PCT/US2016/045180, dated Oct. 12, 2016.
Office Action regarding Chinese Patent Application No. 201610157658.2, dated Sep. 26, 2017. Translation provided by Unitalen Attorneys at Law.
Restriction Requirement regarding U.S. Appl. No. 15/222,361 dated Jan. 11, 2018.
Office Action regarding Indian Patent Application No. 1344/MUM/2012, dated Feb. 12, 2018.

(56) References Cited

OTHER PUBLICATIONS

Office Action regarding U.S. Appl. No. 14/941,827 dated Mar. 15, 2018.
Office Action regarding U.S. Appl. No. 15/222,361, dated Apr. 17, 2018.
Office Action regarding Chinese Patent Application No. 201610157658.2, dated May 30, 2018. Translation provided by Unitalen Attorneys at Law.
Office Action regarding Chinese Patent Application No. 201710426869.6, dated Aug. 1, 2018. Translation provided by Unitalen Attorneys at Law.
Notice of Allowance regarding U.S. Appl. No. 14/941,827, dated Oct. 18, 2018.
U.S. Appl. No. 16/252,997, filed Jan. 21, 2019, Mikhail A. Antimonov et al.
U.S. Appl. No. 16/253,030, filed Jan. 21, 2019, Mikhail A. Antimonov et al.
Notice of Allowance regarding U.S. Appl. No. 14/159,526, dated Apr. 30, 2015.
Notice of Allowance regarding U.S. Appl. No. 13/869,567, dated Sep. 22, 2015.
Notice of Allowance regarding U.S. Appl. No. 15/222,361, dated Nov. 6, 2018.
Office Action regarding Chinese Patent Application No. 201680051384.7, dated Nov. 14, 2018. Translation provided by Unitalen Attorneys at Law.
Office Action regarding Korean Patent Application No. 10-2018-7005832, dated Feb. 18, 2019. Translation provided by KS KORYO International IP Law Firm.
Office Action regarding Korean Patent Application No. 10-2018-7005832, dated Jul. 17, 2019. Translation provided by KS KORYO International IP Law Firm.
Office Action regarding Chinese Patent Application No. 201910288717.3, dated Jun. 12, 2020. Translation provided by Unitalen Attorneys at Law.
Office Action regarding Chinese Patent Application No. 201680051384.7, dated Aug. 2, 2019. Translation provided by Unitalen Attorneys at Law.
Office Action regarding U.S. Appl. No. 16/252,997, dated Apr. 24, 2020.

* cited by examiner

COMPRESSOR INCLUDING BEARING AND UNLOADER ASSEMBLY

CROSS-REFERENCE TO RELATED APPLICATIONS

This application is a continuation of U.S. application Ser. No. 14/159,526, filed Jan. 21, 2014, which claims the benefit of U.S. Provisional Application No. 61/755,222, filed on Jan. 22, 2013. The entire disclosures of the above applications are incorporated herein by reference.

FIELD

The present disclosure relates to a compressor bearing assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand. Furthermore, reducing wear on components of the compressor may increase the longevity of the compressor and the climate-control system.

SUMMARY

This section provides a general summary of the disclosure, and is not a comprehensive disclosure of its full scope or all of its features.

In one form, the present disclosure provides a compressor that may include a drive shaft, a compression mechanism, a bearing and an unloader. The drive shaft may include a main body and a crank pin extending from the main body. The compression mechanism may include first and second members. The crank pin may drivingly engage the second member and cause motion of the second member relative to the first member. The bearing may rotatably supporting the main body of the drive shaft. The unloader may rotatably engage the bearing and slidably engage the main body.

In some embodiments, the first member may be a non-orbiting scroll and the second member may be an orbiting scroll.

In some embodiments, the first member may be a cylinder of a rotary compressor and the second member may be a rotor of a rotary compressor.

In some embodiments, the main body may include a flat surface that is substantially parallel with a longitudinal axis of the main body. The unloader may include a flat surface that slidably engages the flat surface of the main body.

In some embodiments, the main body may include a recess having first and second flat surfaces that are substantially parallel to a longitudinal axis of the main body. The unloader may be at least partially received in the recess and may include first and second flat surfaces that engage the first and second flat surfaces of the main body. The first and second flat surfaces of the unloader may be substantially perpendicular to each other.

In some embodiments, the compressor may include a biasing member disposed between the first flat surface of the main body and the first flat surface of the unloader. The biasing member may bias the first flat surfaces of the main body and the unloader away from each other in a direction that is substantially perpendicular to the longitudinal axis of the main body.

In some embodiments, the unloader may include a radial surface that extends from the first flat surface of the unloader to the second flat surface of the unloader. The radial surface may rotatably engage the bearing.

In some embodiments, the drive shaft may rotate about a longitudinal axis of the main body.

In some embodiments, the crank pin may be eccentric relative to the main body.

In some embodiments, the main body may include first and second axial end portions. The bearing may rotatably support the first axial end portion. The crank pin may be located at the first axial end portion. The compressor may include another bearing rotatably supporting the second axial end portion.

In some embodiments, the compressor may include a member having an inner surface engaging the crank pin and an outer surface engaging an annular surface of a hub of the orbiting scroll.

In some embodiments, engagement between the crank pin and the orbiting scroll may be substantially radially non-compliant.

In some embodiments, the compressor may include a variable-speed motor driving the drive shaft.

In another form, the present disclosure provides a compressor that may include a drive shaft having a main body and a crank pin. The crank pin may drivingly engage a first member of a compression mechanism and cause orbital motion of the first member relative to a second member of the compression mechanism. The main body may be supported by a bearing and may be radially compliant at the bearing.

In some embodiments, the first member may be an orbiting scroll and the second member may be a non-orbiting scroll.

In some embodiments, the first member may be a rotor of a rotary compressor and the second member may be a cylinder of a rotary compressor.

In another form, the present disclosure provides a compressor that may include a drive shaft, a compression mechanism, a bearing, and an unloader. The drive shaft may include a main body and an eccentric portion. The main body may include a recess. The compression mechanism includes a first member and a second member. The eccentric portion may drivingly engaging the first member and cause motion of the first member relative to the second member. The bearing may be axially spaced apart from the first and second members. The bearing may rotatably support and engage the main body of the drive shaft. The unloader may rotatably engage the bearing and may be slidably received in the recess of the main body.

In another form, the present disclosure provides a compressor that may include a drive shaft and an unloader. The drive shaft may include a main body and a crank pin. The crank pin includes a longitudinal axis that is offset from a longitudinal axis of the main body. The crank pin may drivingly engage a first member of a compression mechanism and may cause motion of the first member relative to a second member of the compression mechanism. The main body may rotatably engage a bearing and is radially compliant at the bearing. The unloader may rotatably engage the bearing and may be slidably received within a recess in the main body. The recess is axially spaced apart from the crank pin.

In another form, the present disclosure provides a compressor that may include a drive shaft, a compression mechanism, a bearing, an unloader, and a biasing member. The drive shaft may include a main body and an eccentric portion. The main body may include a recess defined by first and second flat surfaces of the drive shaft that are substantially parallel to a rotational axis of the main body. The compression mechanism includes a first member and a second member. The eccentric portion may drivingly engage the first member and cause orbital motion of the first member relative to the second member. The bearing may be axially spaced apart from the first and second members. The bearing may rotatably support and engage the main body of the drive shaft. The unloader may rotatably engage the bearing and may be slidably received in the recess of the main body. The unloader may include first and second flat surfaces that are angled relative to each other. The first flat surface of the unloader may engage the first flat surface of the drive shaft. The second flat surface of the unloader faces the second flat surface of the drive shaft. The unloader may include a curved surface that extends from the first flat surface of the unloader to the second flat surface of the unloader. The curved surface may rotatably engage the bearing. The biasing member may be disposed between the first flat surface of the drive shaft and the first flat surface of the unloader. The biasing member may bias the first flat surfaces of the drive shaft and the unloader away from each other in a direction that is substantially perpendicular to the rotational axis of the main body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
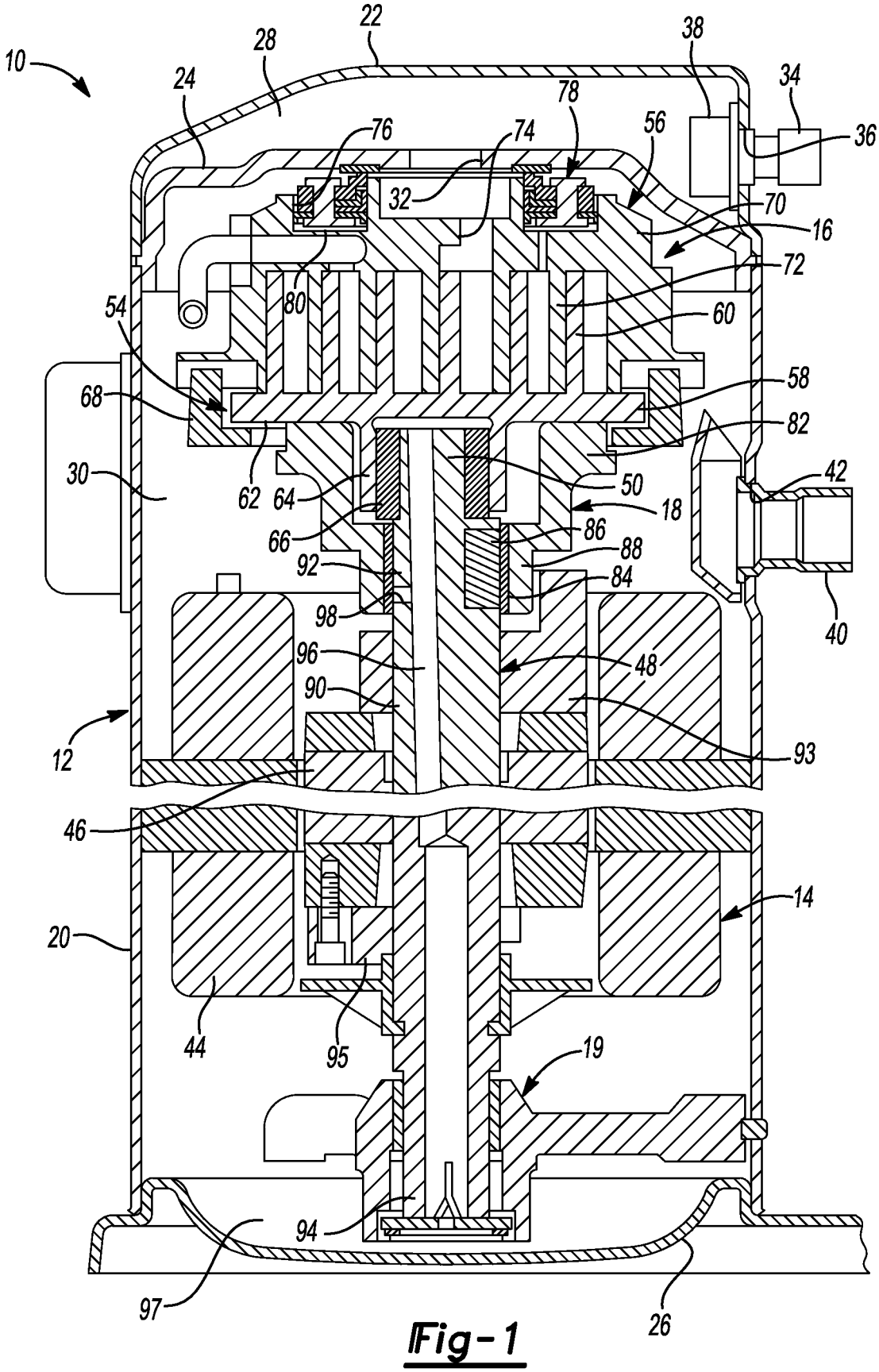
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a motor assembly 14, a compression mechanism 16, a first bearing assembly 18, and a second bearing assembly 19.

The shell assembly 12 may form a compressor housing and may include a cylindrical shell 20, an end cap 22 at an upper end thereof, a transversely extending partition 24, and a base 26 at a lower end thereof. The end cap 22 and the partition 24 may define a discharge chamber 28. The partition 24 may separate the discharge chamber 28 from a suction chamber 30. The partition 24 may define a discharge passage 32 extending therethrough to provide communication between the compression mechanism 16 and the discharge chamber 28. A discharge fitting 34 may be attached to shell assembly 12 at an opening 36 in the end cap 22. A discharge valve assembly 38 may be disposed within the discharge fitting 34 or proximate the discharge passage 32 and may generally prevent a reverse flow condition through the discharge fitting 34. A suction inlet fitting 40 may be attached to shell assembly 12 at an opening 42.

The motor assembly 14 may include a motor stator 44, a rotor 46, and a drive shaft 48. The motor stator 44 may be press fit into the shell 20. The rotor 46 may be press fit on the drive shaft 48 and may transmit rotational power to the drive shaft 48. The drive shaft 48 may be rotatably supported by the first and second bearing assemblies 18, 19. In some embodiments, the motor assembly 14 may be a variable-speed motor configured to drive the drive shaft 48 at any of a plurality of non-zero speeds. While the motor assembly 14 is shown in FIG. 1 as being disposed within the shell assembly 12, in some configurations, the compressor 10 could be an open-drive compressor driven a motor assembly disposed outside of the shell assembly 12.

The compression mechanism 16 may include an orbiting scroll 54 and a non-orbiting scroll 56. The orbiting scroll 54 may include an end plate 58 having a spiral wrap 60 on a first side thereof and an annular flat thrust surface 62 on a second side. The thrust surface 62 may interface with the first bearing assembly 18, as will be subsequently described. A cylindrical hub 64 may project downwardly from the thrust surface 62. A drive bearing 66 may be received within the hub 64. The crank pin 50 of the drive shaft 48 may drivingly engage the drive bearing 66. An Oldham coupling 68 may be engaged with the orbiting and non-orbiting scrolls 54, 56 to prevent relative rotation therebetween. In some embodiments, the crank pin 50 could include a flat surface formed thereon that slidably engages a corresponding flat surface in a drive bushing (not shown) that engages the drive bearing 66.

The non-orbiting scroll 56 may include an end plate 70 and a spiral wrap 72 projecting downwardly from the end plate 70. The spiral wrap 72 may meshingly engage the spiral wrap 60 of the orbiting scroll 54, thereby creating a series of moving fluid pockets. The fluid pockets defined by the spiral wraps 60, 72 and end plates 58, 70 may decrease in volume as they move from a radially outer position (e.g., at a suction pressure) to a radially inner position (e.g., at a discharge pressure that is higher than the suction pressure) throughout a compression cycle of the compression mechanism 16.

The end plate 70 may include a discharge passage 74 and an annular recess 76. The discharge passage 74 is in communication with at least one of the fluid pockets at the radially inner position and allows compressed working fluid (at or near the discharge pressure) to flow therethrough and into the discharge chamber 28. The annular recess 76 may at least partially receive a floating seal assembly 78 and may cooperate with the seal assembly 78 to define an axial biasing chamber 80 therebetween. The biasing chamber 80 may receive intermediate-pressure fluid from a fluid pocket formed by the compression mechanism 16. A pressure differential between the intermediate-pressure fluid in the biasing chamber 80 and fluid in the suction chamber 30 exerts a net axial biasing force on the non-orbiting scroll 56 urging the non-orbiting scroll 56 toward the orbiting scroll 54 to facilitate a sealed relationship therebetween.

The first bearing assembly 18 may include a bearing housing 82, a bearing 84, and an unloader 86. The bearing housing 82 may be fixed relative to the shell assembly 12 and may include an annular hub 88 that receives the bearing 84. The bearing housing 82 and bearing 84 may cooperate to support the drive shaft 48 for rotational motion relative thereto. The bearing housing 82 may also axially support the orbiting scroll 54 for orbital motion relative thereto.

Figure 2:
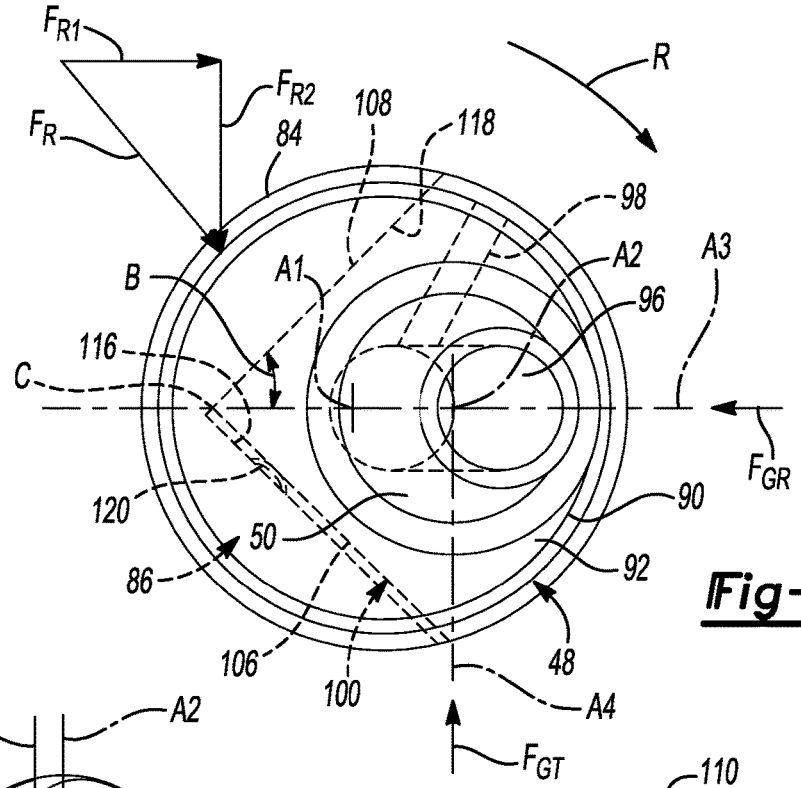
FIG. 2 is a top view of a drive shaft and a portion of a bearing assembly of the compressor of FIG. 1.
Figure 3:
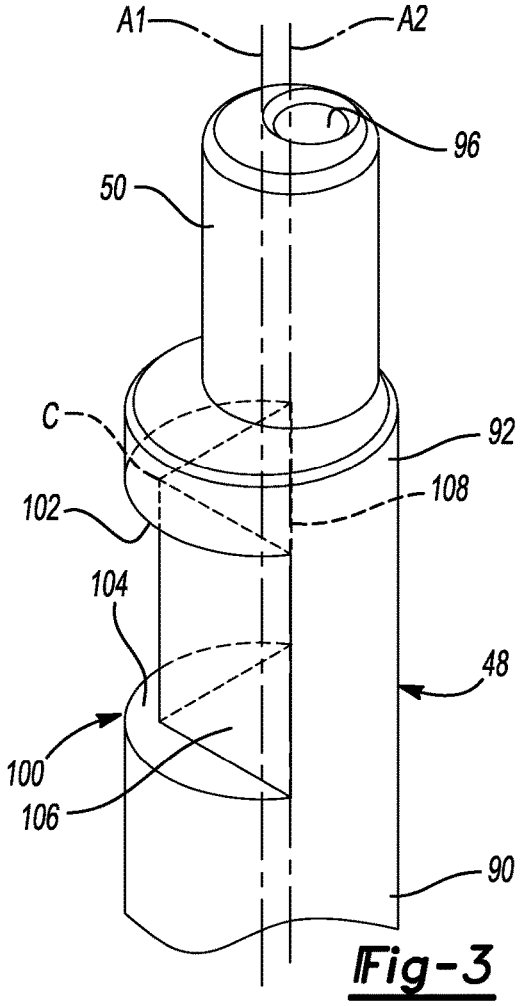
FIG. 3 is a perspective view of the drive shaft according to the principles of the present disclosure.

Referring now to FIGS. 1-3, the drive shaft 48 may include a main body 90 having first and second end portions 92, 94 rotatably supported by the first and second bearing assemblies 18, 19, respectively. The crank pin 50 may extend from the first end portion 92. An oil passage 96 may extend through the length of the drive shaft 48 from the second end portion 94 through the first end portion 92 and through the crank pin 50. During operation of the motor assembly 14, oil from an oil sump 97 may be pumped up through the oil passage 96 to supply oil to the drive bearing 66. Oil may also flow from the oil passage 96 to the bearing 84 through a supply passage 98 that extends radially outward from the oil passage 96.

As shown in FIG. 1, first and second counterweights 93, 95 may be attached to the main body 90 between the first and second bearing assemblies 18, 19 to rotationally balance the drive shaft 48. The first and second counterweights 93, 95 may be configured and positioned such that an inertial force of the first counterweight 93 may counteract or balance a sum of inertial forces of the second counterweight 95, the orbiting scroll 54 and the crank pin 50.

As shown in FIGS. 2 and 3, the main body 90 of the drive shaft 48 may include a recess 100 formed therein at or proximate the first end portion 92. The recess 100 may be generally aligned with the bearing 84 in an axial direction. The recess 100 may include first and second axial ends 102, 104 and first and second flat surfaces 106, 108. The first and second axial ends 102, 104 may define respective planes that may be substantially perpendicular to and intersecting a longitudinal axis A1 of the drive shaft 48. The first and second flat surfaces 106, 108 extend from the first axial end 102 to the second axial end 104 and may be substantially perpendicular to the first and second ends 102, 104.

Figure 4:
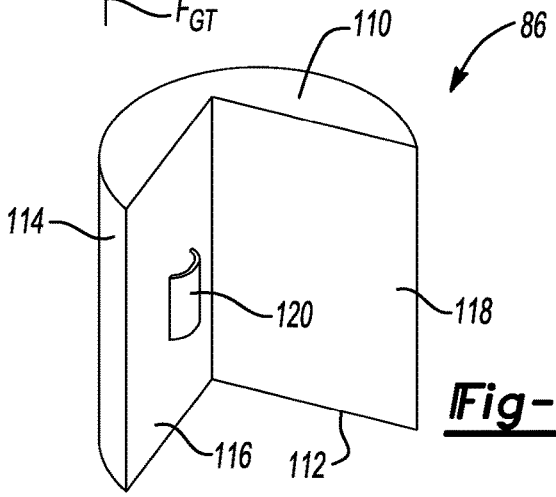
FIG. 4 is a perspective view of a bearing unloader according to the principles of the present disclosure.

As shown in FIG. 2, the unloader 86 may be received in the recess 100 and may provide axial compliance for the drive shaft 48 and the orbiting scroll 54. As shown in FIG. 4, the unloader 86 may be a semi-cylindrical or partially cylindrical body having first and second axial ends 110, 112, a curved surface 114 and first and second flat surfaces 116, 118. A distance between the first and second axial ends 110, 112 may be approximately equal to or slightly less than a distance between first and second axial ends 102, 104 of the recess 100. The curved surface 114 may include a radius that is approximately equal to a radius of the main body 90 of the drive shaft 48. The first and second flat surfaces 116, 118 of the unloader 86 may slidably engage the first and second flat surfaces 106, 108, respectively, of the recess 100. An angle between the first and second flat surfaces 116, 118 may be substantially equal to an angle between the first and second flat surfaces 106, 108. In some embodiments, the angle between the first flat surface 106 and the second flat surface 108 and/or the angle between the first flat surface 116 and the first flat surface 118 may be approximately ninety degrees or between approximately eighty and one-hundred degrees, for example. In some embodiments, a spring 120 (FIGS. 2 and 4) may be disposed between the first flat surface 106 of the recess 100 and the first flat surface 116 of the unloader 86. The spring 120 may bias the flat surfaces 106, 116 away from each other.

Figure 5:
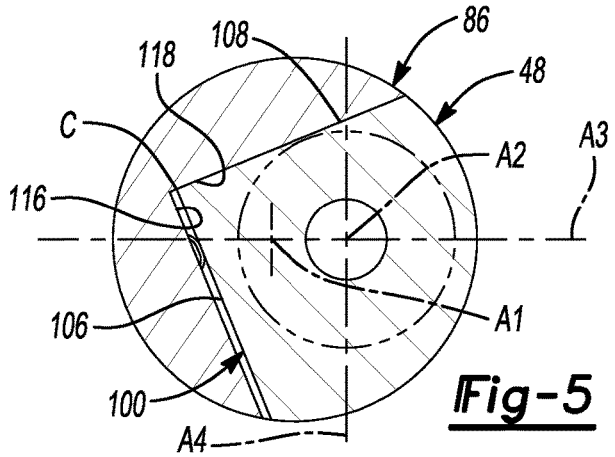
FIG. 5 is a top view of another drive shaft and a portion of a bearing assembly according to the principles of the present disclosure.

As shown in FIG. 2, the second flat surface 108 may be oriented at an angle B relative to an axis A3. The axis A3 may be an axis that is perpendicular to and intersects axes A1, A2. As described above, the axis A1 is the longitudinal axis of the main body 90 of the drive shaft 48. The axis A2 is a longitudinal axis of the crank pin 50 of the drive shaft 48. While a corner C of the recess 100 is shown in FIG. 2 as being disposed along axis A3, in some embodiments, the recess 100 and the unloader 86 can be oriented so that the corner C is offset from the axis A3 (as shown in FIG. 5).

During operation of the compressor 10, in which the drive shaft 48 may be rotating in a direction R (FIG. 2) about the axis A1, radial gas forces $F_{GR}$ (occurring along axis A3) and tangential gas forces $F_{GT}$ (occurring along an axis A4 perpendicular to the axis A3) from the compression of the working fluid in the compression mechanism 16 are transferred to the drive shaft 48 and bearing 84. The gas forces $F_{GR}$, $F_{GT}$ cause a reaction force $F_R$ to be applied to the main body 90 of the drive shaft 48. The reaction force $F_R$ is transferred to the second flat surface 108. The angle B of the second flat surface 108 may be selected such that a first component $F_{R1}$ of the reaction force $F_R$ balances the gas force $F_{GR}$ and a difference between a second component $F_{R2}$ of the force $F_R$ and the gas force $F_{GT}$ results in a sufficient force to overcome the biasing force of the spring 120 and close or reduce a gap between the flat surfaces 106, 116 of the drive shaft 48 and unloader 86, respectively. In some embodiments, the angle B may be between approximately twenty and thirty degrees, for example. In some embodiments, the angle B may be between approximately twenty and forty-five degrees, for example.

While the drive shaft 48 and unloader 86 are described above as being incorporated into a vertical, hermetic compressor, it will be appreciated that the principles of the present disclosure may be applicable to horizontal and/or open-drive compressors, for example, or any other type of high-side or low-side compressor or pump. It will be appreciated that the drive shaft 48 and unloader 86 could be incorporated into a compressor having a floating non-orbiting scroll (e.g., an axially compliant non-orbiting scroll) or a compressor having a fixed non-orbiting scroll.

While the compression mechanism 16 is described above as being a scroll-type compression mechanism, it will be appreciated that the principles of the present disclosure may be applicable to rotary compressors. That is, the drive shaft 48 and first bearing assembly 18 (with the unloader 86) may be configured to drive a rotor of a rotary-type compression mechanism.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a drive shaft including a main body and an eccentric portion, said main body including a recess;

a compression mechanism disposed within said shell and including a first member and a second member, said eccentric portion drivingly engaging said first member and causing motion of said first member relative to said second member;

a bearing housing fixed within said shell;

a bearing housed within and supported by said bearing housing, said bearing axially spaced apart from said first and second members, said bearing rotatably supporting and engaging said main body of said drive shaft; and an unloader rotatably engaging said bearing and slidably received in said recess of said main body, wherein said bearing is disposed radially outward relative to said unloader and extends circumferentially around said unloader, wherein said unloader is slidable within said recess in a direction that is perpendicular to a rotational axis of said drive shaft.

2. The compressor of claim 1, wherein said recess is defined by a flat surface of said drive shaft that is substantially parallel to a rotational axis of said main body, and said unloader includes a flat surface that slidably engages said flat surface of said drive shaft.

3. The compressor of claim 1, wherein said recess is defined by first and second flat surfaces of said drive shaft that are substantially parallel to a rotational axis of said main body.

4. The compressor of claim 3, wherein said unloader includes first flat surface and a second flat surface, said first flat surface of said unloader engages said first flat surface of said drive shaft, said second flat surface of said unloader faces said second flat surface of said drive shaft.

5. The compressor of claim 4, wherein said first and second flat surfaces of said unloader are substantially perpendicular to each other.

6. The compressor of claim 4, further comprising a biasing member disposed between said first flat surface of said drive shaft and said first flat surface of said unloader, said biasing member biasing said first flat surface of said drive shaft and said first flat surface of said unloader away from each other in a direction that is substantially perpendicular to said rotational axis of said main body.

7. The compressor of claim 4, wherein said unloader includes a curved surface that extends from said first flat surface of said unloader to said second flat surface of said unloader, said curved surface rotatably engaging said bearing.

8. The compressor of claim 1, wherein said eccentric portion extends from an axial end of said main body.

9. The compressor of claim 1, further comprising another bearing rotatably supporting said main body.

10. The compressor of claim 9, further comprising a drive bearing rotatably supporting said eccentric portion and disposed within an annular hub of said first member.

11. The compressor of claim 1, wherein said first and second members are scroll members.

12. The compressor of claim 1, further comprising a variable-speed motor driving said drive shaft.

13. The compressor of claim 1, wherein said recess extends only partially around a circumference of said main body of said drive shaft.

14. The compressor of claim 13, wherein said unloader is rotationally fixed relative to said drive shaft.

15. A compressor comprising:

a compression mechanism;

a drive shaft having a main body and a crank pin, said crank pin having a longitudinal axis that is offset from a longitudinal axis of said main body, said crank pin drivingly engaging a first member of said compression mechanism and causing motion of said first member relative to a second member of said compression mechanism, said main body rotatably engages a bearing and is radially compliant at said bearing; and an unloader received within a recess in said main body, wherein said unloader rotatably engages said bearing during operation of the compressor, wherein said bearing is disposed radially outward relative to said unloader and extends circumferentially around said unloader, wherein said unloader is slidable within said recess in said main body during operation of the compressor, wherein said recess is axially spaced apart from said crank pin, and wherein said unloader is slidable within said recess in a direction that is perpendicular to a rotational axis of said drive shaft.

16. The compressor of claim 15, wherein said recess is defined by first and second flat surfaces of said drive shaft that are substantially parallel to a rotational axis of said main body, and wherein said unloader includes a first flat surface and a second flat surface, said first flat surface of said unloader engages said first flat surface of said drive shaft, said second flat surface of said unloader faces said second flat surface of said drive shaft.

17. The compressor of claim 16, wherein said first and second flat surfaces of said unloader are angled relative to each other.

18. The compressor of claim 16, further comprising a biasing member disposed between said first flat surface of said drive shaft and said first flat surface of said unloader, said biasing member biasing said first flat surface of said drive shaft and said first flat surface of said unloader away from each other in a direction that is substantially perpendicular to said rotational axis of said main body.

19. The compressor of claim 16, wherein said unloader includes a curved surface that extends from said first flat surface of said unloader to said second flat surface of said unloader, said curved surface rotatably engaging said bearing.

20. The compressor of claim 15, further comprising:

another bearing rotatably supporting said main body; and a drive bearing rotatably supporting said crank pin and disposed within an annular a hub of said first member.

21. The compressor of claim 15, wherein said first and second members are scroll members.

22. The compressor of claim 15, wherein said crank pin extends from an axial end of said main body.

23. The compressor of claim 15, further comprising a variable-speed motor driving said drive shaft.

24. The compressor of claim 15, wherein said recess extends only partially around a circumference of said main body of said drive shaft.

25. The compressor of claim 15, wherein said unloader is rotationally fixed relative to said drive shaft.

26. A compressor comprising:

a drive shaft including a main body and an eccentric portion, said main body including a recess defined by first and second flat surfaces of said drive shaft that are substantially parallel to a rotational axis of said main body;

a compression mechanism including a first member and a second member, said eccentric portion drivingly engaging said first member and causing orbital motion of said first member relative to said second member;

a bearing axially spaced apart from said first and second members, said bearing rotatably supporting and engaging said main body of said drive shaft;

an unloader rotatably engaging said bearing and slidably received in said recess of said main body, said unloader includes first and second flat surfaces that are not parallel to each other, said first flat surface of said unloader engages said first flat surface of said drive shaft, said second flat surface of said unloader faces said second flat surface of said drive shaft, said unloader including a curved surface that extends from said first flat surface of said unloader to said second flat surface of said unloader, said curved surface rotatably engaging said bearing; and a biasing member disposed between said first flat surface of said drive shaft and said first flat surface of said unloader, said biasing member biasing said first flat surface of said drive shaft and said first flat surface of said unloader away from each other in a direction that is substantially perpendicular to said rotational axis of said main body.

27. The compressor of claim 26, wherein said recess extends only partially around a circumference of said main body of said drive shaft.

28. The compressor of claim 27, wherein said unloader is slidable within said recess in a direction that is perpendicular to a rotational axis of said drive shaft.

29. The compressor of claim 28, wherein said unloader is rotationally fixed relative to said drive shaft.

* * * * *